United States Patent [19]

Zink

[11] 4,231,318

[45] Nov. 4, 1980

[54] DUAL BLADE COATER

[75] Inventor: Stanley C. Zink, Fulton, N.Y.

[73] Assignee: The Black Clawson Company, Middletown, Ohio

[21] Appl. No.: 921,502

[22] Filed: Jul. 3, 1978

[51] Int. Cl.[2] ..... B05C 11/04

[52] U.S. Cl. ..... 118/122; 118/316; 118/411; 427/356; 427/209

[58] Field of Search ..... 118/122, 316, 411, 410; 427/356, 209

[56] References Cited

U.S. PATENT DOCUMENTS

| | | | |
|---|---|---|---|
| 1,753,447 | 4/1930 | Zeidell et al. | 118/122 |
| 3,187,718 | 6/1965 | Coghill | 118/122 |
| 3,418,970 | 12/1968 | Phelps et al. | 118/410 |
| 3,521,602 | 7/1970 | Coghill | 118/410 |
| 3,575,134 | 4/1971 | Quint | 118/122 |
| 3,882,817 | 5/1975 | Zink | 118/122 |
| 3,889,018 | 6/1975 | Quint | 118/122 |
| 3,930,464 | 1/1976 | Wallsten | 118/122 |
| 4,063,531 | 12/1977 | Zitzow | 118/122 |
| 4,076,865 | 2/1978 | Wallsten | 427/356 |
| 4,122,218 | 10/1978 | Bostrum | 427/209 |

FOREIGN PATENT DOCUMENTS

| | | | |
|---|---|---|---|
| 347781 | 8/1972 | Sweden | 118/122 |

OTHER PUBLICATIONS

Paper Technology, vol. 9, #3 (1968) pp. 231–234.

Encyclopedia of Chemical Technology, 3rd Ed. pp. 790, 791.

Wallsten, The Twin Blade Coating Process, paper presented at the 1976 TAPPI Coating conference.

*Primary Examiner*—Ralph S. Kendall

*Attorney, Agent, or Firm*—Biebel, French & Nauman

[57] ABSTRACT

A dual blade fountain coater for simultaneously coating the opposite sides of a moving web of paper includes a pair of oppositely positioned, non-contacting fountains and a pair of oppositely positioned metering blade assemblies which are mounted for movement about a common transverse pivot axis, which pivot axis is substantially coincidental with the blade contacting region on the web. Each assembly is independently adjustable of the other for adjusting blade angle and each fountain is similarly independently adjustable for varying the coating contacting region and dwell time. Metering bars may be mounted on the blades.

8 Claims, 10 Drawing Figures

DUAL BLADE COATER

BACKGROUND OF THE INVENTION

It is often desired to coat both sides of a web simultaneously, and to meter the applied coating with blades. Dual blade coaters have been known in the art for many years. An example of one such coater is shown in Quint, U.S. Pat. No. 3,575,134 issued Apr. 13, 1971, and the divisional patent to the same inventor, U.S. Pat. No. 3,889,018 issued June 10, 1975. Quint employs relatively thick elastomeric blades in a range of ¼" to ½" with flat beveled working surfaces which are at least in partially flush engagement with the opposite sides of the web. In Quint, the blades are adjusted about pivot axes which are remote from the blade-engaging surfaces, and thus Quint could not use thin steel blades. He stated that thin steel blades having a thickness of 0.014" to 0.030" would result in the tearing of the paper web and represented that as a practical matter it would be impossible to align them with the web surface so that they would accurately oppose each other.

A more recent patent disclosing apparatus for coating both sides of a web is Zitzow, U.S. Pat. No. 4,063,531 issued Dec. 20, 1977. The problem of precise control of tip alignment in Zitzow is eliminated by causing the opposed blades to be pressed together at the web over a relatively wide transverse region such that the arc of curvature of the blades becomes tangient to the surface of the web against which they are pressed. Again, as in Quint, the blades are mounted for pivotal movement about an axis remote from the contact region, and the coating apparatus is restricted to one in which the blades are adjusted to form equal angles to the web.

In the prior patent of Zink, U.S. Pat. No. 3,882,817 issued May 13, 1975, assigned to the same assignee as this invention, it is suggested that a double sided coater could be made in which the blades are mounted so that they are pivoted about a common axis which includes the apex or tips of the blades, and it was also suggested that they could be mounted for independent movement such as through a 15° angle, for example. No structure was disclosed by means of which the suggested independent angular adjustment of the opposite blades could be achieved. A dip or immersion-type coater was diagrammatically disclosed, and no arrangement was suggested by means of which the coating dwell on either side of the web could be independently controlled.

A single blade coater in which a blade was mounted for pivotal movement about an axis which included the contact region or tip of the blade against the web was shown in Coghill, U.S. Pat. No. 3,187,718 issued June 8, 1965 and assigned to the same assignee as this invention.

SUMMARY OF THE INVENTION

This invention is directed to a twin-blade type of coater for applying a coating simultaneously to opposite sides of a moving web of paper or the like, in which a pair of metering blades are mounted for blade angle adjustment movement about a transverse axis which is in common with the contact region or tips of the blades, thereby eliminating criticality of the application of the blades to the surface to be coated, and permitting the use of relatively thin coating blades, such as metal blades, for example.

Coating is applied in the present apparatus by a pair of oppositely disposed fountains which are angularly adjustable and movable so that the point of impingement by the fountain on the web may be independently controlled at either side of the web, and thus the coating dwell times may be controlled. In addition, the blade incidence angles are independently controllable so that precise metering and coating of the coated material may be effected for the coating applied on each side of the web. The fountain applicators are of the non-contacting type and apply a jet or transverse film of coating to the web surface. Thus, the coating applicators permit wrinkles in the paper and the like to pass through without inducing a force on the web, and the web to some extent is free to move transversely within the gap defined by the opposed fountains.

The fountains are adjustable so that the coating width may be controlled, by controlling the effective width of fountain orifice. In addition, a coating may be applied in strips, if desired.

The dwell between the jet applicator and the metering blades is adjustable by appropriately adjusting the position of the fountains which are mounted separate and independent of each other, and from the blade supporting structure.

Air tubes are employed to move the blades into the doctoring position and to apply the requisite force to the blades. This, in combination with the structure which permits the blades to be independently adjusted about their contact point, provides a coater with versatility. In fact, metering rods may be substituted for either or both of the blades, as desired.

Thus, a further advantage of the coater is the provision of means for changing bevel blade angles on the run since the blades may be rotated about their tips, and thus changing the blade angle of either of the blades does not result in any substantial change in the contact region of the blade at the web.

When operating the coater in the unbeveled "zero" angle mode, rotating the blade holders will result in a substantial change in contact region of the blade to the web, sufficient to adjust coating weight simultaneously or independently.

It is accordingly an important object of this invention to provide a twin-blade coater for applying a coating to opposite sides of a moving web of paper or the like in which the blades are mounted for pivotal movement about an axis which is substantially coincidental with a common transverse contacting region of the blade tips, in which non-contacting fountains are employed for applying a coating to the web, in which the fountains, as well as the blades, are independently adjustable for varying the location of coating impingement and thereby varying coating dwell, in which the blades are independently retractable to provide for cleaning and blade adjustment without disturbing the position of the other blade, and in which a pneumatic loading tube is positioned to apply a loading force to each of the blades.

These and other objects and advantages of the invention will be apparent from the following description, the accompanying drawings and the appended claims.

BRIEF DESCRIPTION OF THE DRAWINGS

FIGS. 7–10 diagrammatically illustrate versatility in coating arrangements which are possible with this invention, in which FIG. 7 illustrates a condition in which the thin blades are set at unequal angles with respect to the web, FIG. 8 illustrates an arrangement in which the blades are pressed together so that a portion of the surface of each blade is substantially tangient to the web, FIG. 9 illustrates the use of one metering bar in place of one of the blades, and FIG. 10 illustrates the employment of two metering bars in lieu of thin blades. Here, changing blade angle will distribute wear of rods should the rods be of the stationary type.

DESCRIPTION OF PREFERRED EMBODIMENT

Figure 1:
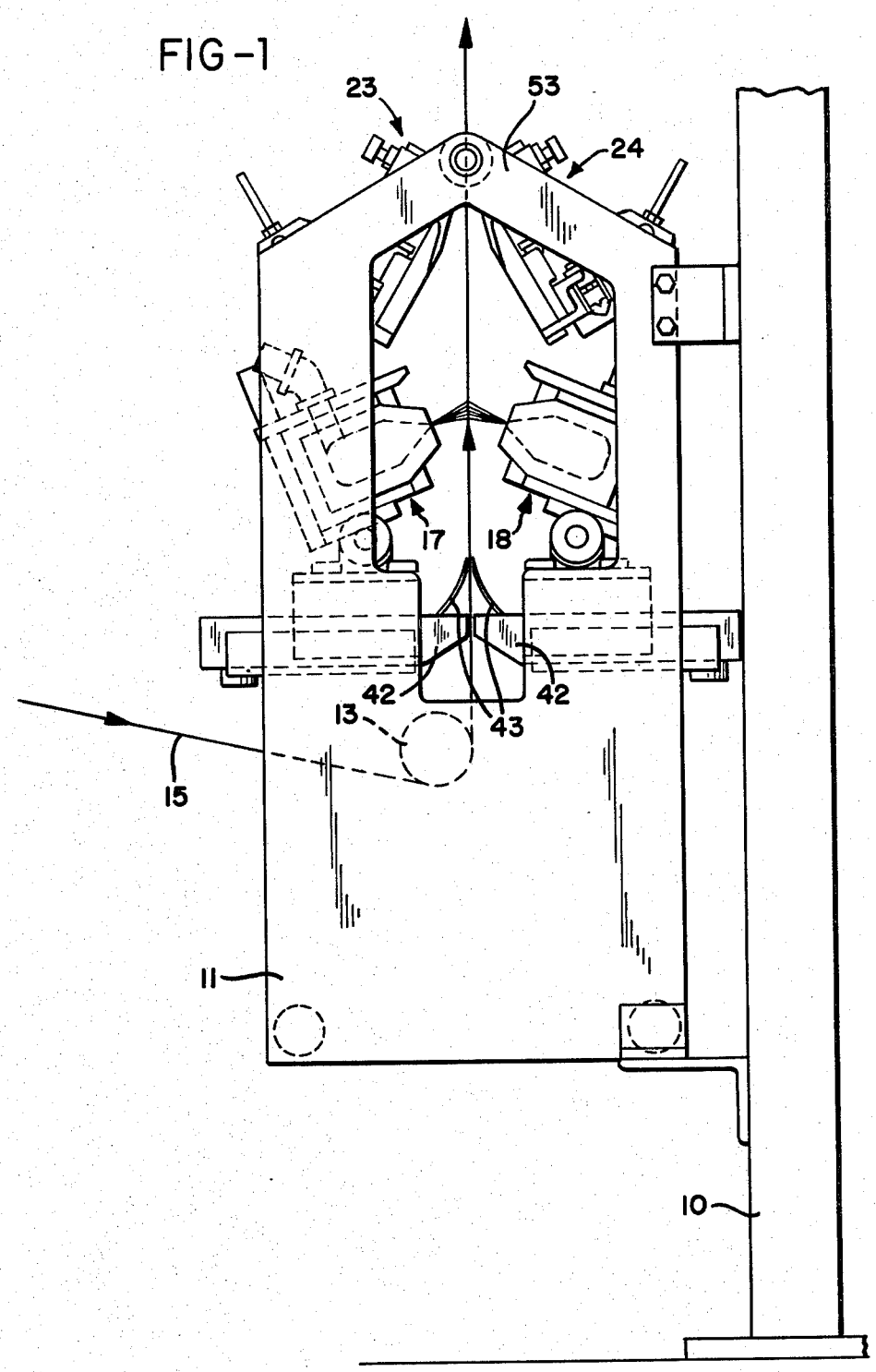
FIG. 1 is a side elevational view of a coater in accordance with this invention.
Figure 2:
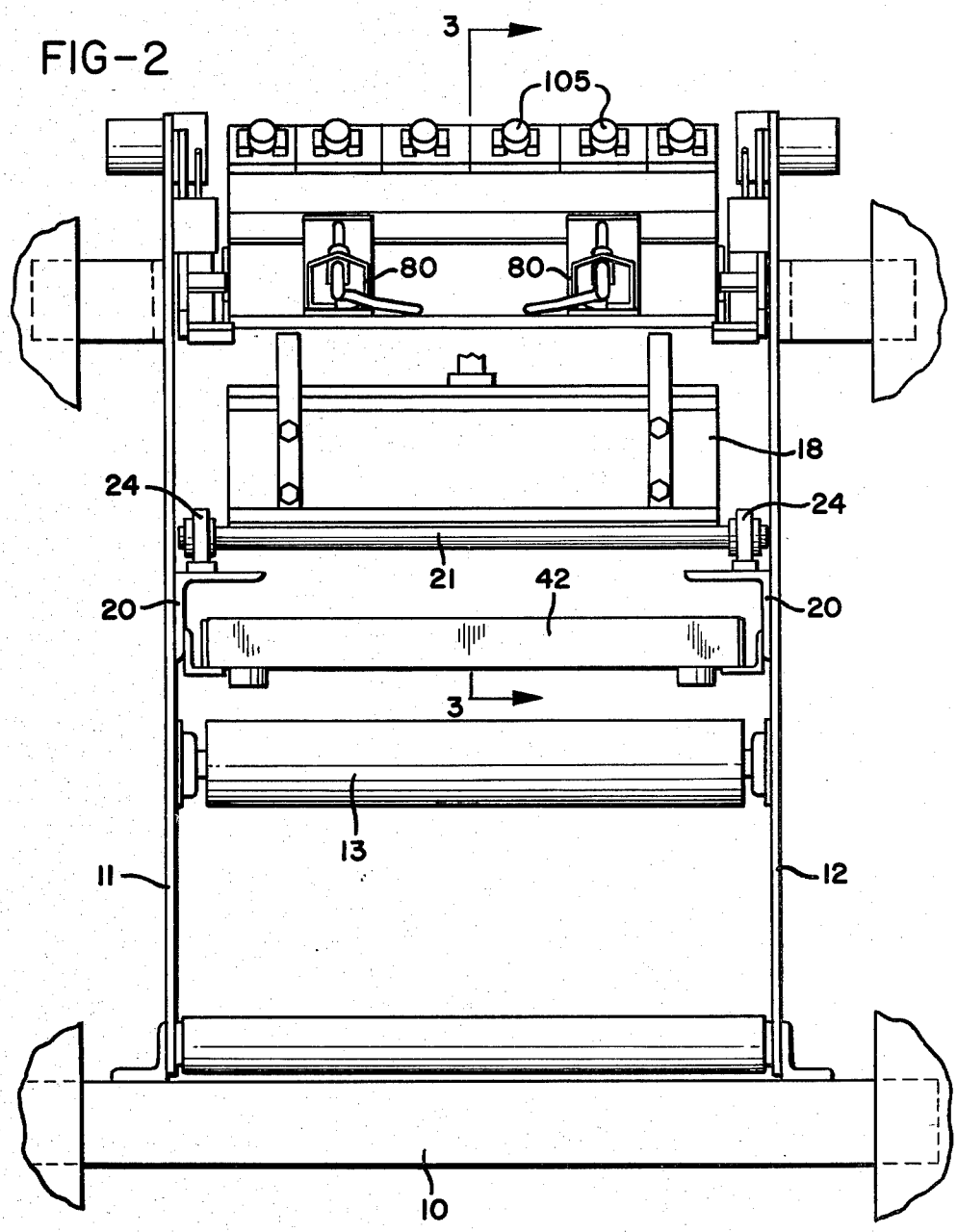
FIG. 2 is a rear elevational view thereof.

Referring first to FIG. 1, a twin-blade coater is illustrated as mounted on a side frame or stand 10, but it is understood that the coater may also be supported by any other conventional means, such as by an underlying floor stand. The coater itself includes a pair of transversely spaced, relatively open side frames 11 and 12, as shown in FIG. 2. The frames 11 and 12 rotatably support a guide roller 13 for turning and guiding a web 15 of paper upwardly through the coater.

The side frames 11 and 12 also support independent fountain means for applying a film of coating material to the opposite sides of the web 15 and these preferably include a pair of identical coating fountains 17 and 18. The fountains are of the general type disclosed in the patents of Phelps et al, U.S. Pat. No. 3,418,970 issued Dec. 31, 1968 and Coghill, U.S. Pat. No. 3,521,602 issued July 28, 1970, and are positioned at opposite sides of the web 15 on generally L-shaped brackets 20. As seen in FIG. 2, the fountains are pivotally supported on the brackets 20 on a transverse rod 21 supported in bearings 24, to the end that the fountains may be rotated between selected operative positions and a fully retracted position.

The side frames 11 and 12 also support a pair of identical metering blade assemblies illustrated generally at 23 and 24 in FIG. 1.

Figure 3:
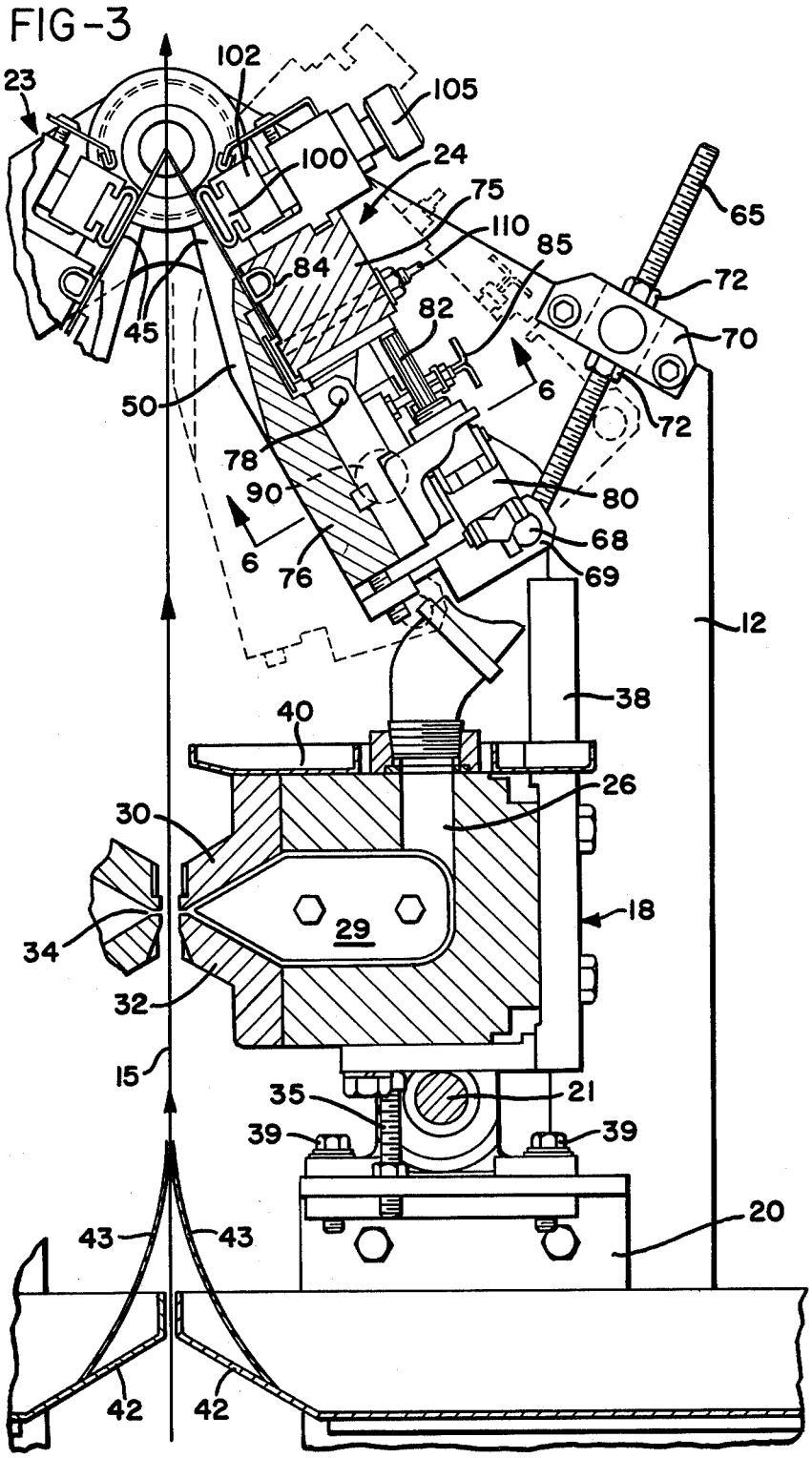
FIG. 3 is an enlarged vertical section through the coater showing primarily the right half of the coating structure with the view being taken generally along the line 3—3 of FIG. 2.

Referring to FIG. 3, the fountain 18 is shown in section as including a central inlet 26 into which coating material may flow into an internal transverse cavity 28. The effective width of the cavity may be varied or controlled by a suitable internal expanding elastomeric end plug 29 (shown in elevation in FIG. 3) of the type shown in FIG. 5 of Coghill, U.S. Pat. No. 3,609,810 issued Oct. 5, 1971. By clamping plates on either side of an elastomeric seal and raising the seal to expand in the cavity 21, the effective width of the fountain may be controlled.

The fountain 18 is provided with a pair of lips 30 and 32 defining therebetween a transversely elongated orifice 34, through which the coating flows as a jet or stream for impingement against the adjacent surface of the web 15. The gap or width of the orifice or slot 34 may be adjusted to define the amount of coating applied to the web 15 and the transverse width may be deckled by the use of the expanding plug 29.

Figure 4:
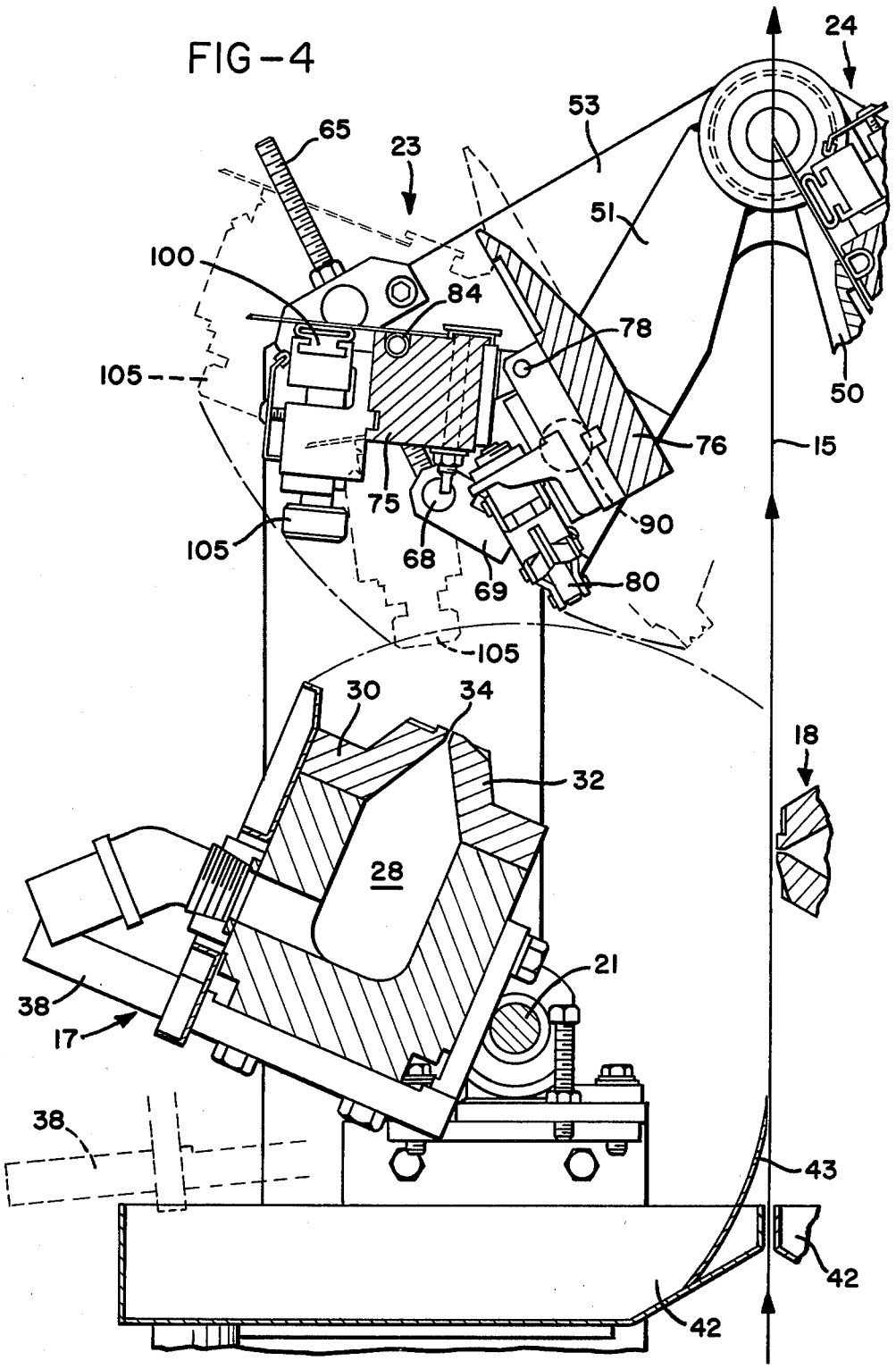
FIG. 4 is a vertical section similar to FIG. 3, but showing the apparatus for coating the opposite or left side, with the parts shown as displaced to a moved position such as for cleaning or for blade changing, as compared to the operative position shown in FIG. 3.

The fountain 18 is shown in FIG. 3 in one preferred operating position defined by a threaded stop bolt 35 in the bracket 20. A pair of handles or actuators 38 extend upwardly at the back of the fountain and provide means by which the fountain may be manually rotated about the axis of the rod or shaft 21 between an operative position, as shown in FIG. 3, and a retracted position as shown in FIG. 4, in which the opposite fountain 17 is tilted back for cleaning or adjustment. Fountain supporting bolts 39 are received in slotted openings in the bracket 20 by means of which the spacing of the orifice 34 in relation to the web 15 may be controlled. Further, the threaded stop bolt 35 may be adjusted to provide either a downward or an upward tilt to either one or both of the fountains, and an upward tilt position is illustrated in FIG. 1. Thus, by these means, either of the fountains 17 or 18 may be positioned and angularly adjusted in relation to the web 15 and thus the coating dwell can be varied. In addition, the amount of coating applied to each side of the web 15 can be varied independently by adjusting the slot or orifice 34 of each of the fountains and by varying the rate or quantity of coating fluid being applied through the inlet 26 to the internal fountain cavity 28.

By reference to FIGS. 1 and 3 it may also be seen that in the operative position the fountain applicators are in non-contacting relation to the web 15 and thus wrinkles can pass between the fountains and will not introduce a drag on the web 15. The lips 30 and 32 act as a nozzle and produce a uniform curtain of coating which is applied to either side of the web 15. A catch pan 40 is mounted on the upper surface of each of the fountains and a coating return pan 42 may be positioned in underlying relation to each of the fountains. The upper pan 40 is positioned to receive the coating which is removed by the blade assemblies 23 and 26. The pans 42 support a pair of opposed flexible coating deflector foils 43 for returning coating to the supply pans, which is of advantage when running the web 15 at relatively slow speeds.

Both blade assemblies are illustrated in operative position in FIG. 3, while the assembly 23 is shown in a retracted and open position shown in FIG. 4. Each assembly is essentially identical in construction and accordingly, the description of the components and operation which follows applies to either blade assembly.

Each of the blade assemblies 23 and 24 supports a relatively thin metering blade 45 thereon for coaction with the web 15 at opposite sides thereof. For example, the blades 45 may be formed of metal with a thickness as little as 0.010" or less up to and including 0.025" or greater. Typical blade thicknesses are 0.012", 0.015", 0.020", and 0.025", all of which may be characterized as thin blades as distinguished from the relatively thick elastomeric blades necessarily employed in prior arrangements, as identified above under the "background" section of the application. The ability of the present coater to use opposed thin blades resides in the fact that blade alignment is accurately maintained by reason of the fact that the entire blade subassemblies 23 and 24 are pivotally mounted to the frames 11 and 12 to provide for adjustment of incidence angles of the blades about a transverse axis, which is coincidental or substantially coincidental with the transverse region of blade contact with the web. This movement may be considered as a primary blade movement and is illustrated with respect to the assembly 24, by the broken line positions shown in FIG. 3.

Figure 5:
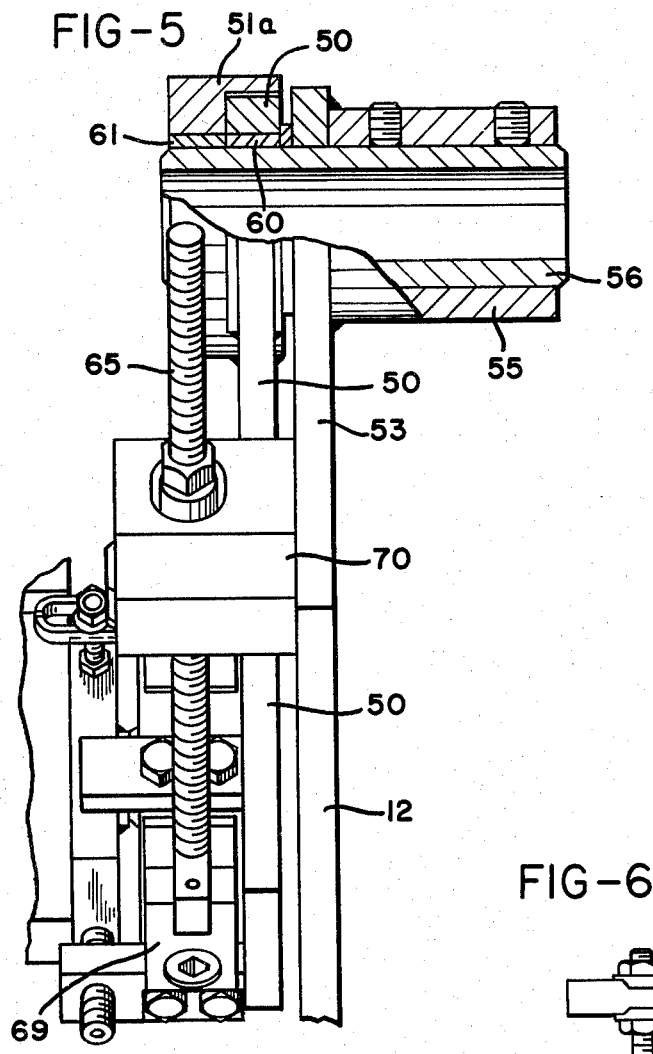
FIG. 5 is an enlarged fragmentary view, partially in section, showing the manner in which the blade support arms are pivotally mounted on the frame.

For this purpose, the blade assemblies 23 and 24 are mounted on pairs of primary arms 50 and 51 which are commonly pivoted to the frames 11 and 12 at the apex of a support or bridge portion 53 of these frames. One of the pivotal arrangements of the adjacent arms 50 and 51 is illustrated in FIG. 5. It will be seen that the frame 12, at the apex of the bridge portion 53, supports an outwardly extending sleeve 55 which is welded to the bridge portion 53. The sleeve 55 in turn removably supports an internal bushing-supporting sleeve 56, which extends through a suitable aperture formed in the bridge portion 53 inwardly of the associated end frame. A pair of sleeve bearings 60 and 61 are supported on the outer surface of the inner sleeve 56 immediately inwardly of the adjacent side frame 12, and the arm 50 is rotatably mounted on the bearing 60 while the arm 50, which lies in the same plane as the arm 51, is rotatably mounted on the bearing 60. The upper end of the arm 51 has a slotted sleeve portion 51*a* formed as an extension of the arm 51 and as telescoped over the end of the arm 50. The sleeve portion 51*a* thus extends inwardly to engage the underlying bearing 61.

The hollow internal sleeve 56 provides a sighting opening through which the tips of the blades 45 may be viewed to facilitate positioning and adjustment. An identical arm-supporting and pivoting structure is provided for the opposite pairs of arms 50 and 51 on the frame 11, to the end that the entire blade assembly 24 turns about the same axis as the blade assembly 23 is mounted.

Means for independently adjusting the angle of incidence of each of the blades includes an adjusting rod 65 shown in elevation in FIG. 3. The rod 55 has a lower end pivoted at 68 to an end bracket 69 on the assembly 24, and is slidably received through a pivot bushing 70 mounted on the inside surface of the frame 12. It is captured in an adjusted position by a pair of opposite nuts 72 threaded on the rod 65. The rod 65 thus provides means for supporting the blade assembly 24 to present the blade 45 at angles which may be as low as 15° and as great as 55° to the web 15. It is understood that an identical arrangement, including an adjusting rod 65, is provided for the blade assembly 23, as illustrated in FIG. 4, thereby providing for independent adjustment of the incidence angles of the blades 45 associated with each of the blade assemblies.

In addition to the movement of the blade assemblies on the primary support arms 50 and 51 as described above, each blade assembly includes two secondary movements, the first in which the blade support is pivoted outwardly on the arms 50 and 51 to expose the blade without disturbing the working angle of the blades 45, and the second in which the blade clamping bar 75 is pivoted away from the blade backup bar 76, to expose the blade itself for removal and displacement, as shown by the full lines of FIG. 4.

In further explanation, each blade assembly includes a transversely oriented blade back-up bar 76 which extends substantially between the end frames 10 and 11 with the end brackets 69 mounted thereon, forming the main support structure for the assembly. The blade clamping bar 75 is pivotally mounted on the back-up bar on pivot pins 78 for movement between a closed position shown in full lines in FIG. 3 and an open blade-changing position shown in FIG. 4. The blade clamp bar is normally held in its closed position by any suitable means, such as by manually operative toggles 80 (shown in elevation in FIG. 2) which press locating pins 82 against a lower surface of the bar 75 urging this bar in a closed, predetermined clamping position with respect to the back-up bar 76.

The blade support and clamping arrangement may be substantially as shown in the previously identified patent of Zink, U.S. Pat. No. 3,882,817, including a pneumatic blade clamping tube 84, corresponding to the tube 42 of that patent. When the toggles 80 are released the locking pins 82 may be extracted, thereby permitting the clamp bar 75 to rotate about the axes of the pins 78 to the position shown in FIG. 4, thus providing for release and replacement of the associated blade 45.

Figure 6:
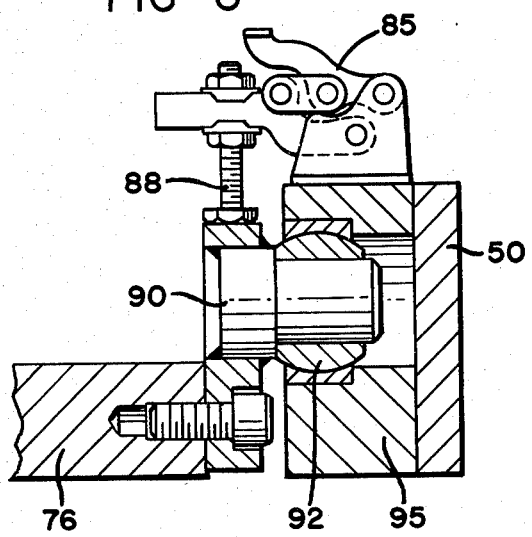
FIG. 6 is a fragmentary transverse section showing the arrangement for pivotally mounting the blade holder assembly on the blade pivot arms, taken generally along the line 6—6 of FIG. 3.

The entire assemblies 23 and 24 are mounted for pivotal movement on the arms 50 and 51 without disturbing the setting of the rod 65. For this purpose, a second toggle clamp arrangement is illustrated in FIG. 6 as including a toggle 85 which urges a threaded adjustable stop 88 against an upper surface of the end bracket 69. End bracket 69 is provided with a stud 90 which receives a spherical bearing 92 within a block or bushing 95 secured to the arm 50, and the release of toggle 85 permits the entire blade assemblies 23 and 24 to be pivoted outwardly about the bearings 92, to move the associated blade 45 away from its working position substantially to the position of the back-up bar 76 shown in full lines in FIG. 4. It will be appreciated that this may be done even while the coater is running, if necessary, to make adjustments in or to replace the associated metering blade 45.

The invention further includes pneumatic loading means for applying a force to the blades 45 intermediate the ends thereof, and for this purpose a transversely oriented loading tube 100 may be mounted in a tube support 102 with an adjacent wall or surface bearing against the blades 45 intermediate the ends. Regulated air pressure is applied to the tube 100, substantially as described in connection with the pneumatic tube 50 of the above-identified Zink U.S. Pat. No. 3,882,817, to control the amount of coating which is doctored by the blade 45. Individual adjusters 105 may be carried on the clamp bar 75, corresponding to the adjusters 55 of Zink U.S. Pat. No. 3,882,817, by means of which fine adjustments may be made in the position of the tube support 102. The structure of the micrometer adjusters is also described fully in the patent of Coghill, U.S. Pat. No. 3,131,092 issued Apr. 28, 1964 and identified therein by the reference numeral 30.

The invention further includes means by which fine adjustments in the effective exposed length of the blades may be achieved. For this purpose, each of the clamp bars 75 includes a pair of rotatable bolts 110 which are normally held in position by lock nuts 111. The head of each bolt is terminated in an eccentrically mounted stop 112 located in the space between the back-up bar 76 and the clamp bar 75. The lower edge of the blades 45 rest on the stops 112, and the rotation of the bolts 110, accompanied by eccentric movement of the stops 112, provides a means for making the fine adjustments in the exposed length of the blades 45.

Figure 7:
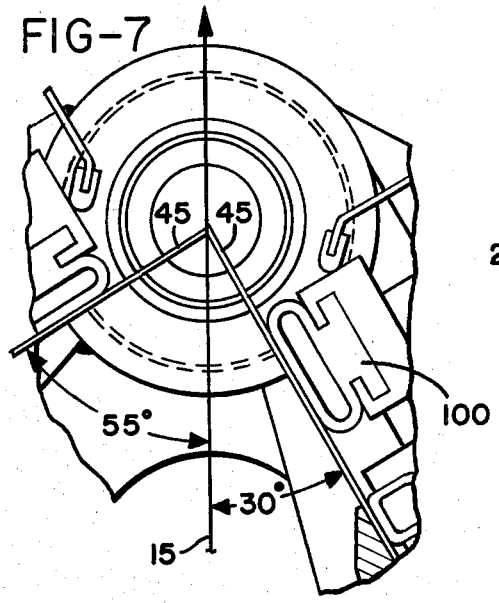

By reason of the fact that the coater assemblies 23 and 24 are individually mounted for rotation about a common axis, for any given condition they may be positioned at optimum doctoring angles. FIG. 7 illustrates a condition in which the blade of the assembly 23 is positioned with an angle of incidence of 55° while the blade of the assembly 24 is positioned at an angle of 30°.

Figure 8:
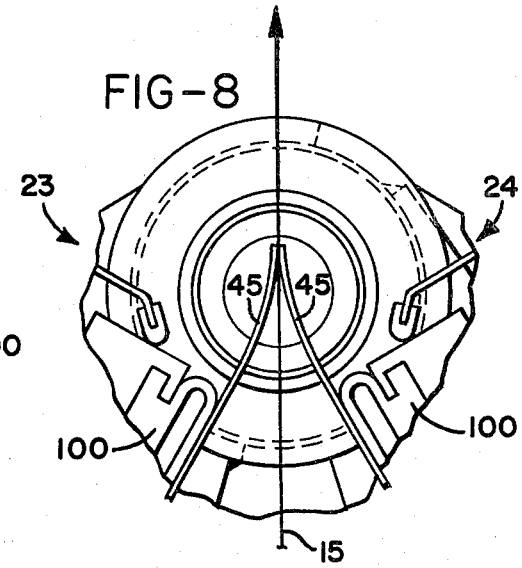

While the metering blades 45 may be brought into precise edge alignment as shown in FIG. 7, they may also be forced into a "zero" angle or tangient relation, as for applying heavier coatings, as shown in FIG. 8. Also, since precise edge adjustment and control is provided, a metering bar 45*a* may be substituted for one or both of the blades 45, as illustrated respectively in FIGS. 9 and 10.

When two blades are used together, as illustrated in FIG. 7, the blade tips come together along a very narrow transversely elongated region, which is essentially a condition of line contact in which the contact region is almost as thin as the blades. In this mode of operation, the angle between the blades, the blade thicknesses and the blade extensions are parameters which establish the range of coating weight, and variations of coating weight control may be accomplished by suitably varying the air pressure within the loading tubes 100. Tests have shown that blade alignment is not difficult to maintain and the movement of the web 15 past the blades and the hydraulic forces which occur at the blade tips tend to equalize blade location.

In FIG. 8, the blades are rotated and deflected to form a partial radius of curvature and thus they form a larger area of contact. When the blades are operated in the mode illustrated in FIG. 8, heavier coating weights are possible.

Figure 9:
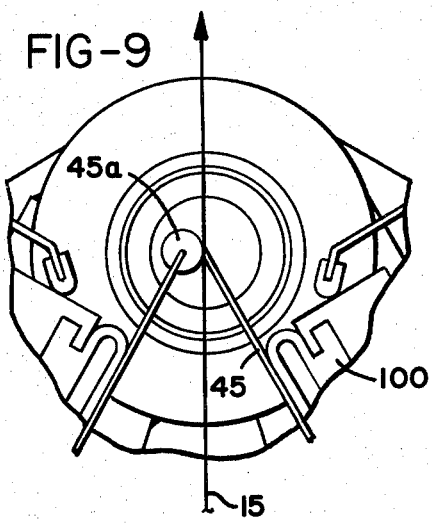

Referring to FIG. 9, the metering rod 45*a* may be a steel rod covered with a wear resistant material such as a ceramic material. The rod 45*a* has a groove machined in it and is mounted to the flexible blade by an epoxy glue or the like, and the coating characteristic is similar to that of a conventional metering rod coater. When this coating characteristic is desired for both sides of the web, the arrangement of FIG. 10 may be used.

Figure 10:
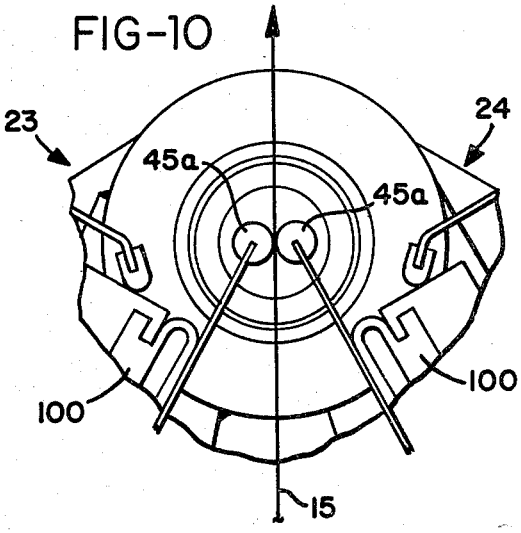

As previously mentioned, the changes of blade angle in the embodiments of FIGS. 9 and 10 will permit the distribution of wear through the metering rods. Also, the twin fountain coater of this invention can be operated without additional metering devices when extreme wet film thicknesses are desired, either on normal webs or on highly absorbent webs. In other words, the coater may be operated with the blades 45 retracted when such heavy or wet film coating is desired.

The operation of the invention is largely selfevident from the foregoing description. The same or different coating materials may be applied to the respective fountain applicators 17 and 18. These fountain applicators are operated in non-contacting relation to the web 15, and the internal deckles are adjusted to provide the desired width of extrusion of the coating material which exits the slot or orifice 34 substantially as a curtain and is applied to the adjacent surface of the web 15. The individual fountains may be positioned laterally or rotated about the rod 21 as required to achieve the desired coating results and to vary the dwell times between the region of application and the region of blade metering. As previously noted, the blade assemblies are brought into operative position by rotation about the pivot defined at the spherical bearings 92 on the stubs 90 to bring each of the assemblies into predetermined operative position, while the position of the blades may be viewed through the axial opening formed through the inner sleeve 56, to determine precise blade location.

Blade height or extension may be controlled by suitable adjustment of the pairs of bolts 110 and as previously noted, the blade angle may be selected by a suitable adjustment of the position of the threaded rod 65. Also, as noted, the individual blades may be changed or retracted for cleaning without the necessity of disturbing this adjustment.

While the form of apparatus herein described constitutes a preferred embodiment of this invention, it is to be understood that the invention is not limited to this precise form of apparatus, and that changes may be made therein without departing from the scope of the invention.

What is claimed is:

1. A twin-blade coater for applying coating materials simultaneously to the opposite sides of a vertically moving web of paper or the like, a pair of generally opposed fountain-type applicators positioned on opposite sides of said vertically moving web in non-contacting relation to said web and each adapted to impinge a stream of coating material against said web, means mounting said applicators for transverse pivotal movement with respect to said web whereby the region of impingement of coating material from each of said applicators may be independently varied, a pair of metering blade assemblies, means mounting said assemblies on said frame for pivotal movement about a common transverse pivot axis vertically spaced from said applicators, blade means on each of said blade assemblies coacting with said web at a common transverse region substantially coincidental with said pivot axis, and independent means associated with each of said assemblies for adjusting the incidence angle of the associated said blade means independently of the other said assembly.

2. The coater of claim 1 further comprising deckle means in said applicators for controlling the transverse widths of the associated said coating material.

3. The coater of claim 1 in which one of said blade means supports a transversely oriented metering rod thereon in contact with said web.

4. The coater of claim 1 in which each of said blade means supports opposed metering rods thereon in contact with said web.

5. A double sided twin blade coater for applying coating materials simultaneously to the opposite sides of a vertically and upwardly moving web of paper or the like comprising:

a frame having transversely spaced apart frame members, means guiding said web vertically upwardly between said members, a pair of coacting fountains mounted between said frame members at opposite sides of said web and oriented for impinging metered quantities of coating materials against the opposite sides of said web, a pair of metering blade assemblies mounted between said frame members above said fountains at opposite sides of said web and having blade means arranged to contact the opposite sides of said web at a generally common transverse region, said web extending between said fountains and said blade means free of any intermediate web contacting or coating smoothing device, said metering blade assemblies having independent adjustment means whereby the incidence angle of each of said blade means with respect to the web may be independently adjusted with respect to the other of said blade means, and separate adjustment means associated with said fountains for independently moving said fountains to adjust the region of impingement of coating material therefrom against said web for varying the coating dwell time between impingement and said region of blade contact.

6. The coater of claim 5 in which said metering blade assemblies each includes a blade holder for said blade means and a pneumatic loading tube positioned between the associated said blade means and said blade holder, said loading tube having a wall portion in contact against the associated said blade means and movable under the influence of regulated air pressure for urging the associated said blade means against said web.

7. A twin-blade coater for applying coating simultaneously to the opposite sides of a moving web of paper or the like, comprising:

a frame, coating means on said frame for applying coating materials to said opposite web sides, a pair of metering blade assemblies each having a metering blade, means mounting said assemblies on said frame at opposite sides of said web for coaction with said web at a common transverse contacting region in spaced relation to said coating means, said mounting means including arm means associated with each of said assemblies, means mounting said arm means on said frame for pivotal movement about a common transverse pivot axis, which axis is substantially coincidental with said common region, each of said assemblies further having means for adjusting the angle of incidence of its associated said blade with said web independently of the angle of incidence of the blade of the other said assembly, said coating means including a pair of independent non-contacting fountain-type applicators positioned on opposite sides of said web and each adapted to impinge a stream of coating material against said web, and means mounting said applicators to said frame providing for independent adjustment of the point of impingement of said coating materials to said web in relation to said common blade-contacting region whereby the coating dwell between the point of aplication and the associated metering blade, on either side of said web, may be independently adjusted.

8. The coater of claim 7 in which said applicator mounting means includes pivot means providing for transverse pivoting movement of each of said applicators to vary the point of impingement of the coating material therefrom on said web.

* * * * *